US008789655B2

(12) United States Patent
Dowie

(10) Patent No.: US 8,789,655 B2
(45) Date of Patent: Jul. 29, 2014

(54) SAFETY APPARATUS

(76) Inventor: Leigh Dowie, Innaloo (AU)

( * ) Notice: Subject to any disclaimer, the term of this patent is extended or adjusted under 35 U.S.C. 154(b) by 1889 days.

(21) Appl. No.: 11/568,508

(22) PCT Filed: May 9, 2005

(86) PCT No.: PCT/AU2005/000656
§ 371 (c)(1),
(2), (4) Date: Nov. 4, 2007

(87) PCT Pub. No.: WO2005/108713
PCT Pub. Date: Nov. 17, 2005

(65) Prior Publication Data

US 2009/0223744 A1 Sep. 10, 2009

(30) Foreign Application Priority Data

May 7, 2004 (AU) ..... 2004902406
Aug. 10, 2004 (AU) ..... 2004904456

(51) Int. Cl.
*A62B 1/10* (2006.01)

(52) U.S. Cl.
USPC ..... 182/234

(58) Field of Classification Search
USPC ..... 182/234, 239, 231, 236, 73; 242/107.3, 242/107.4; 24/132 R; 188/65.1, 65.2; 403/209
See application file for complete search history.

(56) References Cited

U.S. PATENT DOCUMENTS 292,328 A * 1/1884 Lennards ..... 182/236
370,612 A * 9/1887 Fellows ..... 182/73
627,173 A * 6/1899 Benbow ..... 182/236
1,839,691 A * 1/1932 Maxwell ..... 403/209
2,034,841 A * 3/1936 Staggers ..... 24/132 R
2,312,583 A * 3/1943 Penlon ..... 182/6
2,489,971 A * 11/1949 Mitchell ..... 211/119.03
4,213,597 A * 7/1980 Rayner ..... 254/388
4,285,501 A * 8/1981 Schneider ..... 254/394
4,567,962 A * 2/1986 Kladitis ..... 182/5
4,591,021 A * 5/1986 Lew et al. ..... 182/10
4,598,792 A 7/1986 Lew et al.

(Continued)

FOREIGN PATENT DOCUMENTS

BE 1008049 A3 1/1996
GB 2255067 10/1992

OTHER PUBLICATIONS

Supplementary European Search Report dated Jul. 15, 2009, 2 sheets.

*Primary Examiner* — Katherine Mitchell
*Assistant Examiner* — Candace L Bradford
(74) *Attorney, Agent, or Firm* — Banner & Witcoff, Ltd.

(57) ABSTRACT

A safety apparatus (11) comprising a first housing (25) supporting a first spool (17) and a second spool (21) coaxially mounted and independently rotatable. The safety apparatus (11) also comprises a support line (29) extending from the first spool (17) to the second spool (21) via a second support assembly (27). The safety apparatus (11) also comprises a locking device (35) operably movable between a locked condition wherein the first spool (17) and second spool (21) are locked relative to each other and a released condition wherein the first spool (17) and second spool (21) may rotate independently. The locking device (11) is maintained in a locked condition, locking the first spool (17) relative to the second spool (21), when a load of predetermined value, such as the weight of a fallen operator, is exerted upon the support line (29).

36 Claims, 10 Drawing Sheets

(56) References Cited

U.S. PATENT DOCUMENTS

| | | | | | |
|---|---|---|---|---|---|
| 4,620,692 | A | * | 11/1986 | Foreman et al. | 254/277 |
| 4,633,974 | A | | 1/1987 | Weiner et al. | |
| 4,679,656 | A | | 7/1987 | Lew et al. | |
| 4,688,764 | A | * | 8/1987 | Nayler et al. | 254/277 |
| 4,942,943 | A | * | 7/1990 | Flaherty | 182/231 |
| 4,998,683 | A | * | 3/1991 | Wendelborn | 242/383.5 |
| 5,042,613 | A | * | 8/1991 | Hermann | 182/18 |
| 6,178,603 | B1 | * | 1/2001 | Lillig | 24/132 R |
| 6,186,276 | B1 | | 2/2001 | Harbers, Jr. | |
| 2005/0252719 | A1 | * | 11/2005 | May | 182/48 |
| 2009/0211844 | A1 | * | 8/2009 | May | 182/142 |
| 2010/0031480 | A1 | * | 2/2010 | Lin | 24/132 R |

* cited by examiner

SAFETY APPARATUS

FIELD OF THE INVENTION

This invention relates to a safety apparatus, and, more specifically to a safety apparatus used in the prevention of falls.

BACKGROUND ART

In many situations, particularly in the field of construction and building maintenance, an operator may be operating in an environment where he/she is exposed to the danger of falling from an elevated height, which may result in significant injuries.

Many devices have been developed over recent years to prevent or minimize the risk of falling from a work platform. These devices are commonly referred to as fall arresters or fall restraints, and are typically used in combination with some form of harness or belt worn by the operator.

A common form of a fall arrester consists of a single support line, adapted to be secured to an operator's harness, and which is retractably connected to a braking device that is secured to a support structure. With these fall arresters the braking device automatically locks when the velocity of line feed-out exceeds a predetermined value, hence preventing the operator connected to the device falling any further.

Another common form of fall arrester consists of a static support line, or lines, secured between two or more supports. The operator's harness may then be secured to the support line preventing the operator falling a significant distance should he/she lose their footing, whilst allowing the operator to move along the static line.

The above two fall arresters, as well as the many other forms currently available, have significant limitations in their application. For instance, the retractable line systems are only suitable for use in the near vicinity of their point of fixture. If the retractable line was too long, then the operator will experience a significant swing if they fall from a position distant from the point of fixture. This swing can result in significant injuries, particularly if there are objects within the path of the swing.

In relation to the static line systems, problems arise where there are no suitable mounting locations. As this type of system can induce very high lateral loads should a fall take place, it is important that the supports between which the static line span are capable of absorbing such loads. The static line itself can also create a hazard, particularly where it is necessary to mount the line lower than head height. In these situations it can cause serious injury should the operator come into contact with the line during the fall. Static line systems are also cumbersome to erect and use in certain situations. Furthermore, should an operator secured to a static line fall from an area close to one of the supports, the operator will move to the centre point between the supports as he/she falls. This may cause other accidents and/or increase the chance of the operator being injured.

Another limitation with most fall arresters is that they limit the movement of the operator to a particular work platform. Should the operator be required to move to another level, he/she would need to remove him/herself from the fall restraint before going to the other level. This is not only cumbersome, but also leaves the operator vulnerable to falling, as he/she may be unrestrained during the change over.

The reference to the abovementioned prior art is for the purposes of background only and is not, and should not be taken as, an acknowledgement or any form of suggestion that the prior art forms part of the general knowledge in Australia.

It is an object of this invention to provide a safety apparatus which overcomes one or more of the disadvantages of the prior art or provides an alternative to the prior art.

DISCLOSURE OF THE INVENTION

The present invention provides a safety apparatus comprising

- a first receiving means and a second receiving means each adapted to be releasably secured to a structure,
- a locking device operably movable between a released condition whereby the first receiving means and second receiving means can move independently of each other, and a locked condition whereby each receiving means is locked relative to each other,
- a support line having a portion adapted to receive and support a securing device attached to an operator, the support line extending from the first receiving means to the second receiving means, via a second support assembly, wherein when the apparatus supports a fallen operator the locking device is maintained in a locked condition, locking the first receiving means relative to the second receiving means, preventing the length of the support line between the first spool and second spool from increasing, therefore preventing the operator from falling any further.

The support structure may be a building.

The support line may have a first end secured to the first receiving means and a first portion adjacent the first end retractably received by the first receiving means.

The support line may have a second end secured to the second receiving means and a second portion adjacent the second end retractably received by the second receiving means.

Preferably when the locking device is in a locked condition the first receiving means and second receiving means are capable of rotating in a manner whereby the length of line fed from one receiving means is retracted by the other receiving means. When the locking device is in the released condition line may be feed out from both receiving means.

When an operator is connected to the apparatus, horizontal movement of the operator will cause the support line to retract upon one receiving means whilst being feed out from the other receiving means allowing the operator to move along the work platform. However, should the operator experience sudden movement, such as during a fall, the locking device will be maintained in the locked condition ensuring the first receiving means and second receiving means are locked relative to each other, preventing the length of the support line between the first spool and second spool from increasing.

The first receiving means may be in the form of a first spool.

The second receiving means may be in the form of a second spool.

The first spool may be rotatably mounted to a first support assembly. The second spool may be rotatably mounted to the first support assembly such that each spool may rotate independently of each other when the locking device is in the released condition. Preferably the first spool and second spool are mounted coaxially on a shaft.

Preferably each spool is biased in a manner which maintains a retractive force upon the support line. This will ensure that the support line remains as taut as possible regardless of the condition of the locking device. A force would need to be applied upon the support line in order for the support line to be unwound from the respective spool. It will also ensure that the length of support line fed from one spool is retracted onto the other spool.

In one arrangement the locking devices normal state is the locked condition. The locking device may be moved to the released condition by operation of a release device, permitting each spool to rotate independently of each other, and allowing the operator to extend more line, such as may be required when moving to a work platform at a different level. The release device may be manually operated. The release device may be manually operated via a flexible connection, such as a rope, extending between the operator and the release device. The flexible connection may be adapted to disconnect from the release device when the force exerted thereupon is above a predetermined value. This may be the case when the operator falls and instinctively tries to grasp the flexible connection. In this scenario the flexible means will detach without operating the release device and hence unintentionally changing the condition of the locking device to the released condition, unlocking the spools. Preferably when the locking device is in the released condition the locking device will change condition to the locked condition should the velocity of support line feed out exceed a predetermined value. This will ensure that if the operator were to lose his/her footing when the locking device is in the release condition, the locking device will move to the locked condition to arrest the fall of the operator. The locking device may be in the form of a clutch type arrangement, a viscous coupling or other mechanical connection as may be known to the person skilled in the art.

In another arrangement the locking device, when in a locked condition, partially locks the spools relative to each other such that the spools are incapacitated to feed line out simultaneously whilst still being capable of rotating independently from each in a manner which will retract the support line simultaneously.

In another arrangement the locking devices normal state is the released condition, allowing each spool to rotate independently. In this arrangement the locking device may move to the locked condition to lock the spools relative to each other when the velocity of feed from one or both of the spools exceeds a predetermined value, preventing the length of the supporting line between the first spool and second spool from increasing. Preferably the locking device is in the form of an inertia brake.

The locking device may comprise at least one tooth and a ring. Preferably the locking device is in a locked condition when the at least one tooth engages the ring.

The at least one tooth may be rotatably mounted directly or indirectly to the first spool or second spool whereby the rotation of the respective spool is translated to the at least one tooth.

In one arrangement the at least one tooth is mounted on a disc. The disc may be mounted to the first or second spool.

The first spool, second spool and disc may be co-axially mounted.

In another arrangement the at least one tooth is mounted directly to the respective spool.

Preferably the at least one tooth is biased towards the axis of the shaft.

The ring of the locking device may be mounted directly or indirectly to the other spool to which the at least one tooth is directly or indirectly mounted, whereby the rotation of the spool is translated to the ring.

The ring may be mounted on a plate coaxially mounted with the first spool and second spool.

The ring may be mounted on the first spool or second spool.

The first spool, second spool and ring may be co-axially mounted.

Preferably the ring and at least one tooth lie in the same plane vertical to the shaft.

Preferably the ring has a plurality of indents spaced at regular intervals incorporated within the inner periphery of the ring.

The at least one tooth may engage an indent such that the locking device is in the locked condition.

In the arrangement whereby the normal state of the locking device is in the locked condition, the at least one tooth may be held in engagement with the indent.

The at least one tooth may engage the indent under prescribed conditions, such as the velocity of line feed out reaching a predetermined velocity, indicating the operator has fallen from the work platform.

The locking device may incorporate a visual indicator indicating the condition of the locking device. Hence, the visual indicator may indicate when the locking device is in a locked condition and thereby indicating to the operator that the locking device must be released in order for him/her to move to another level.

The first support assembly may comprise a retrieval means. The retrieval means can be used to retrieve a fallen operator and return them to the work platform or lower them to a lower platform. The retrieval means may comprise a handle which may rotate one or both. The handle may be coaxially mounted with the first spool and second spool.

The second support assembly may be in the form of a pulley comprising a wheel retained in a bracket. The pulley may incorporate a braking means to provide resistance to the rotation of the wheel when a predetermined force is exerted thereupon. This force may result from the sudden movement of the operator such as during a fall from the platform.

Preferably the wheel is biased away from the brake lining. The pulley may be biased away from the braking means by a biasing means such as at least one spring. The braking means may comprise a brake lining. The wheel will be forced to engage the brake lining when the force exerted thereupon overcomes the biasing means.

The support line may comprise a first line retractable upon the first spool, and a second line retractable on the second spool. The first line and second line may be releasably connected by a shackle. The securing device attached to the operator may be releasably attached to the shackle to secure the operator to the apparatus.

The first support assembly may be releasably secured to the second support assembly for easy handling and transportation of the apparatus.

The present invention provides a safety apparatus comprising

- a first support assembly adapted to be releasably secured to a structure
- a second support assembly device adapted to be releasably secured to the structure and comprising
  - a first spool and a second spool coaxially mounted, and
  - a locking device operably movable between a released condition whereby the first spool moves relative to the second spool, and a locked condition whereby the first spool is locked relative to the second spool
- a support line having a portion adapted to receive and support a securing device attached to an operator, the support line comprises
  - a first end secured to the first spool and having a portion adjacent the first end retractably received by the first spool, and a second end secured to the second spool and having a portion adjacent the second end retractably received by the second spool, whereby the support line extends from the first spool, via the first support assembly before extending to the second spool, wherein the locking device is maintained in a locked condition, locking the first receiving means relative to the second receiving means, when the apparatus supports a fallen operator.

The present invention provides a safety apparatus comprising a first housing supporting a first spool and a second spool coaxially mounted and independently rotatable;

a support line extending from the first spool to the second spool via a second housing;

a locking device operably movable between a locked condition wherein the first spool and second spool are locked relative to each other and a released condition wherein the first spool and second spool may rotate independently;

wherein the locking device is maintained in a locked condition, locking the first spool relative to the second spool, when a load of predetermined value, such as the weight of a fallen operator, is exerted upon the support line.

The present invention overcomes many of the problems associated with the existing devices used to prevent injuries from falls. The present invention works on a similar principle as a device that consists of two pulleys being fixed to supports on a work platform, with a loop of safety-line running between each pulley. The user can connect to the safety-line and move freely between each support whilst having a mechanical restraint to falling from the platform. The present invention provides versatility to this approach by allowing flexibility in the placement of such a system on work platforms of varying size. The device can be extended between each support as a whole, or it can be erected in two halves and then joined by the safety-line. The device also offers the versatility of allowing the user to move to a work platform at another level, without having to remove the device and replace it at the next level.

BRIEF DESCRIPTION OF THE DRAWINGS

The invention will be better understood by reference to the following description of several embodiments as shown in the accompanying drawings in which.

BEST MODE(S) FOR CARRYING OUT THE INVENTION

Figure 1:
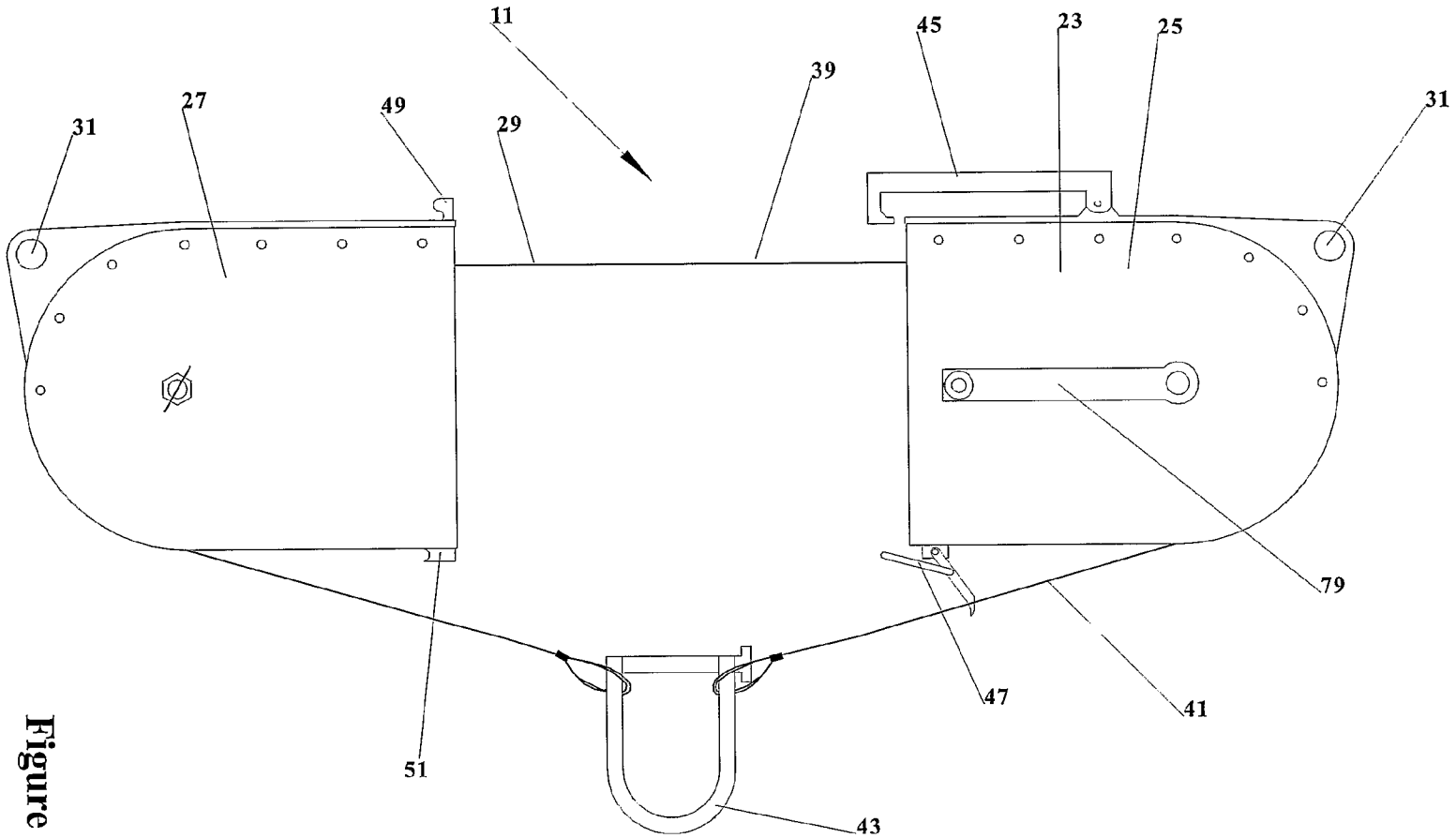
FIG. 1 is a side view of a safety apparatus according to a first embodiment.
Figure 10:
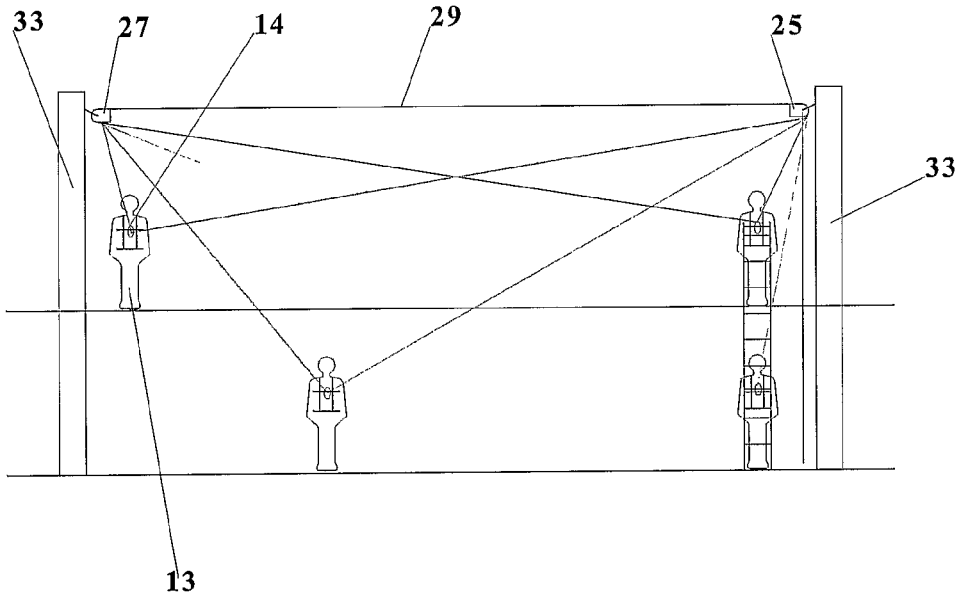
FIG. 10 is a schematic of the safety apparatus in use showing an operator in several positions relative to the apparatus.

Shown in FIG. 1 is a safety apparatus 11 according to a first embodiment. As shown in FIG. 10, the safety apparatus 11 may be used to provide a fall restraint for an operator 13 when operating on elevated work platforms.

Figure 2:
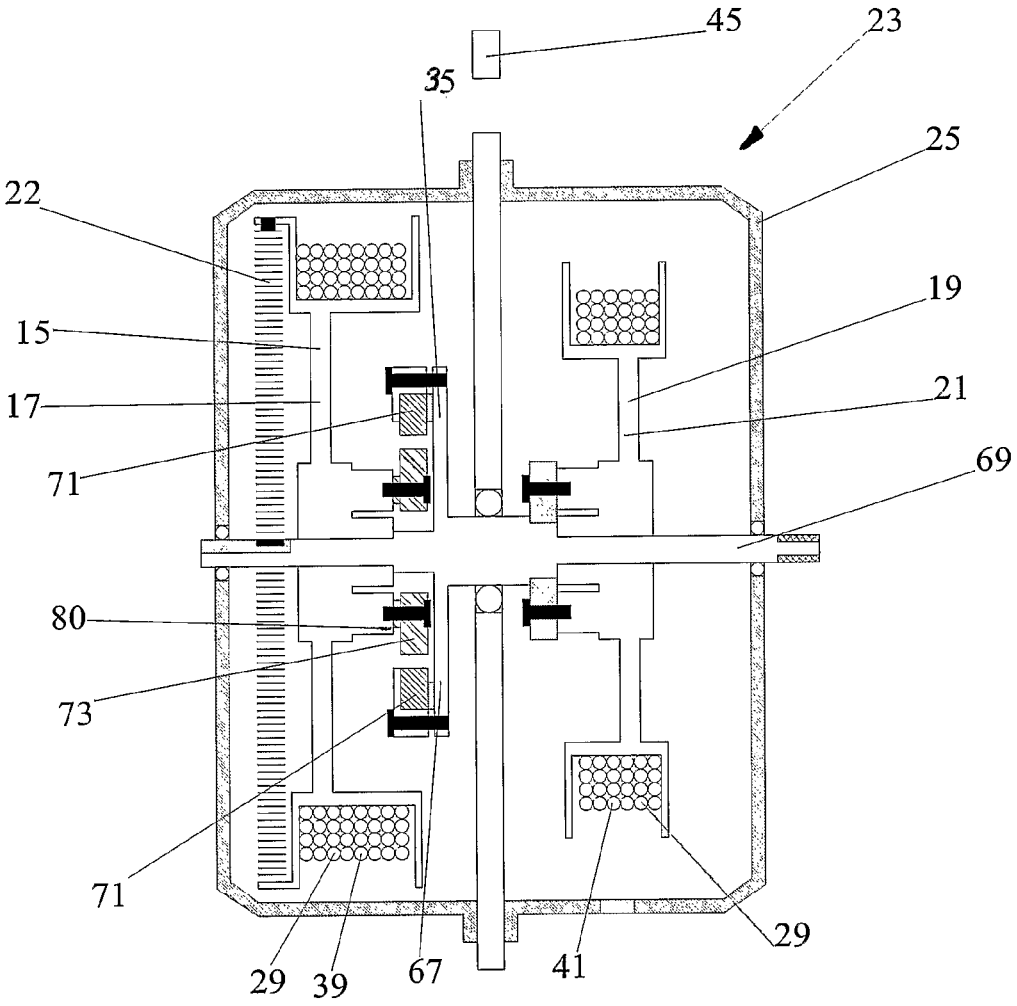
FIG. 2 is a cross sectional view of a first support assembly in a released condition of the safety apparatus according to a first embodiment.

As best shown in FIGS. 1 and 2, the safety apparatus 11 comprises a first receiving means 15 in the form of a first spool 17 and a second receiving means 19 in the form of a second spool 21. The first spool 17 and second spool 21 are rotatably and coaxially mounted in a first support structure 23 which is in the form of a first housing 25. The first spool 17 is rotatably mounted on a shaft 69 which is rotatably mounted in the first housing 25. The second spool 21 is fixed to the shaft 69. The first housing 25 has an aperture 31 to releasably secure the first housing 25 to a structure 33, as shown in FIG. 10.

The safety apparatus 11 comprises a locking device 35 operably movable between a released condition whereby the first spool 17 and second spool 21 can move independently of each other, and a locked condition whereby each spool is partially locked relative to each other, as is described below.

The safety apparatus 11 also comprises a support line 29. The support line 29 extends from the first spool 17 to the second spool 21, passing through a second support assembly 27. The support line 29 comprises a first line 39 retractably received upon the first spool 17 and a second line 41 retractably received upon the second spool 21. The first line 39 and second line 41 are releasably connected by the shackle 43. The shackle 43 is adapted to receive and support a securing device 14 attached to the operator 13.

Figure 3:
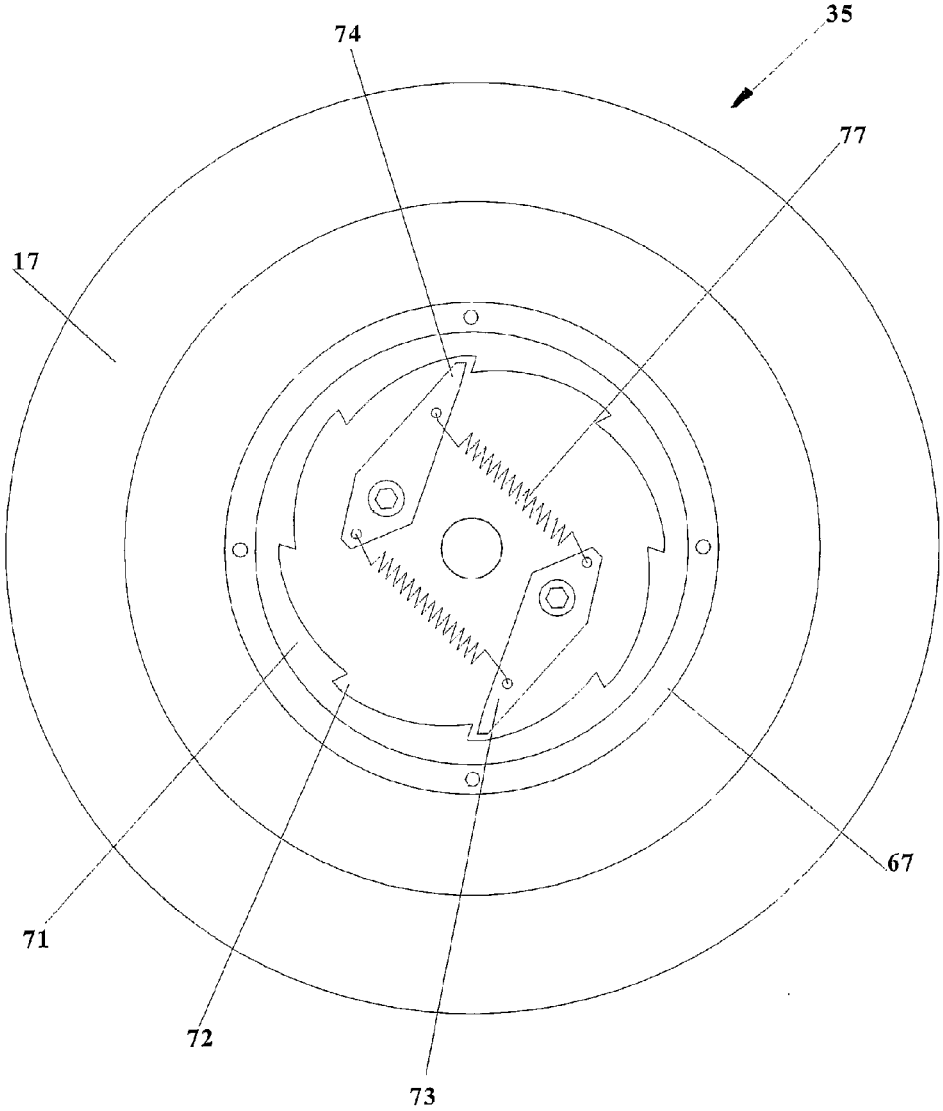
FIG. 3 is a side view of the locking device according to the first embodiment.

The first spool 17 and second spool 21 are biased in a direction such that each spool 17, 21 places a retractive force on the support line 29. As shown in FIG. 3 this biasing is provided by a spring 22. This will ensure that any slack which may develop in the support line 29 will be automatically retracted upon the first spool 17 and/or second spool 21, maintaining the support line 29 in a taut condition.

Figure 4:
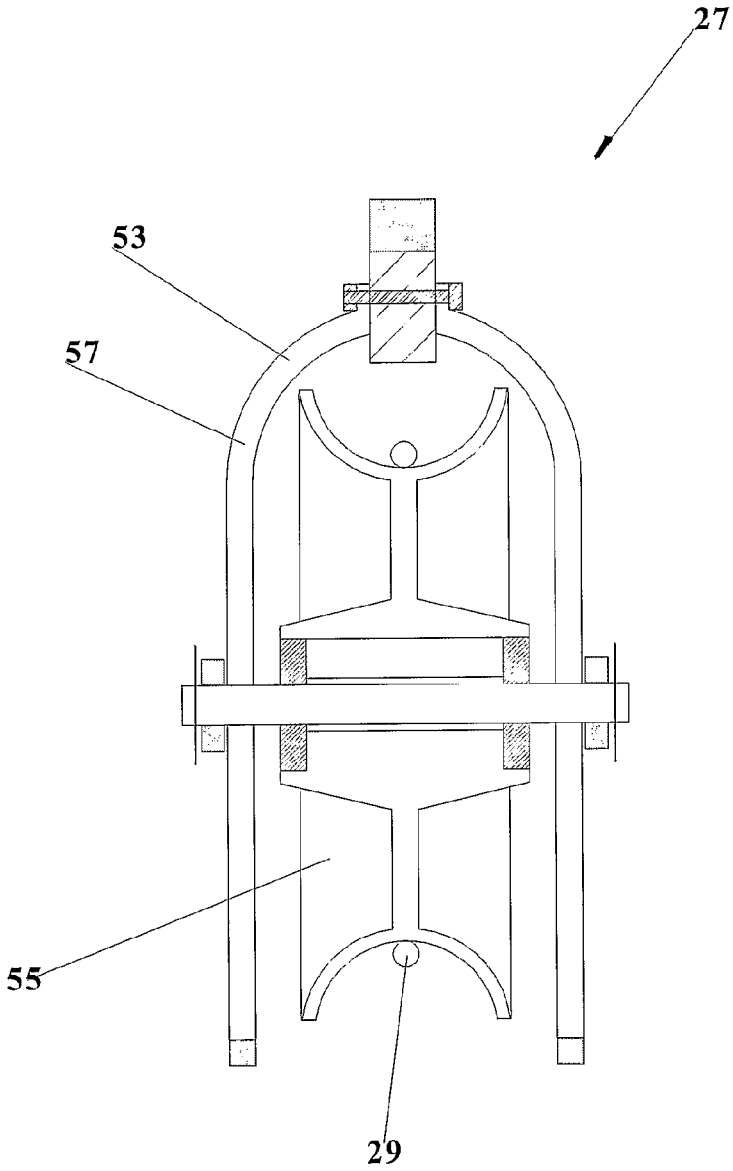
FIG. 4 is a cross sectional view of a second support assembly according to the first embodiment.
Figure 5:
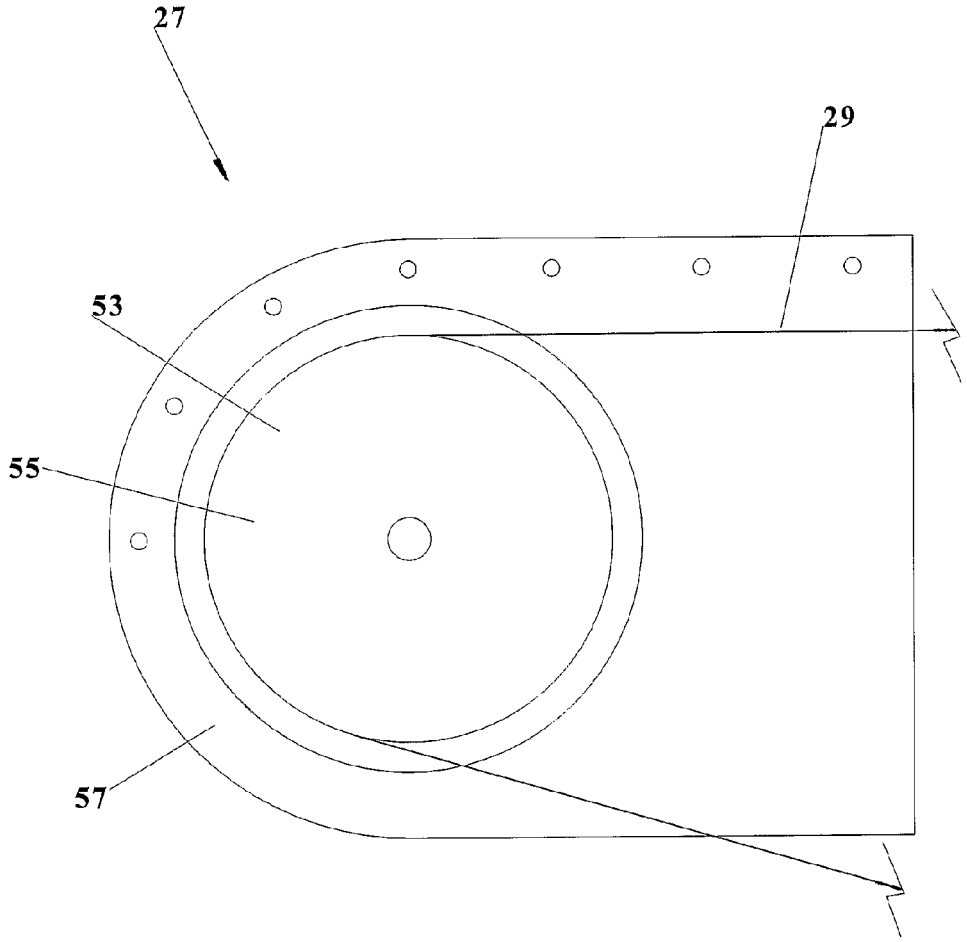
FIG. 5 is a cross sectional side view of the second support assembly according to the first embodiment.

Referring to FIGS. 4 and 5, the second support assembly 27 according to a first embodiment is in the form of a pulley 53 comprising a wheel 55 rotatably retained in a bracket 57. The second support assembly 27 has an aperture 31 so as to be releasably secured to the structure 33, as shown in FIG. 10.

The locking device 35 is operably movable between a locked condition and a released condition. When the locking device 35 is in a locked condition, the first spool 17 and second spool 21 are locked relative to each other such that they are not able to rotate in a manner which will allow the length of support line 29 extending between the first spool 17 and second spool 21 to increase. As discussed above, the locking device 35 is configured such that the support line 29 may be retracted upon the first spool 17 and/or second spool 21 should slack develop in the support line 29.

As shown in FIGS. 2 and 3 the locking device 35 according to the first embodiment is in the form of a plate 67 coaxially mounted with the first spool 17 and second spool 21 on the shaft 69. Secured to an outer portion of the plate 67 is a ring 71. As best shown in FIG. 3, the ring 71 incorporates a plurality of indents 72 spaced at regular intervals around the inner periphery of the ring 71. The locking device 35 also comprises two teeth 73 rotatably mounted on first spool 17 such that they lie in the same plane as the ring 71, as best shown in FIG. 2. The teeth 73 have two springs 77 extending therebetween, biasing an end 74 of each tooth 71 towards the shaft 69.

In the locking devices 35 normal state, each tooth 73 is biased towards the shaft 69 and is not in engagement with the indents 72 on the ring 71. In this state the locking device 35 is in its released condition. The locking device 35 will move to the locked condition when the rotational velocity of the first spool 25 is sufficient such that the centrifugal force exerted upon each tooth 73 overcomes the biasing means of the springs 77. When this velocity is reached the teeth move outwardly each engaging an indent 72, locking the first spool 17 to the second spool 21. In this condition the length of the support line 29 extending between the first spool 17 and second spool 21 will not increase.

The locking device also comprises a clutch plate to absorb some of the impact force experienced by the operator 13 should he/she fall.

The locking device 35 also comprises a handle 79 which may be used to rotate one or both spools 17, 21 to retrieve a fallen operator 13. The safety apparatus 11 also comprises means in which the first housing 25 can be releasably secured to the second support assembly 27 when the apparatus 11 is not secured to a structure for ease of transportation. This means is provided by a bracket 45 which is hingedly connected to the first housing 25 and which is adapted to engage a first protrusion 49 extending from the second support assembly 27. The first housing 25 also has a latch 47 mounted upon the first housing 25, which is adapted to engage a second protrusion 51 extending from the second support assembly 27. To secure the first housing 25 to the second support assembly 27 the bracket 45 is secured over the first protrusion 49 before the latch 47 is hooked over the second protrusion 51 and pushed downwards to lock the first housing 25 and the second support assembly 27 together. The bracket 45 can then be used as a handle to carry the safety apparatus 11.

Figure 6:
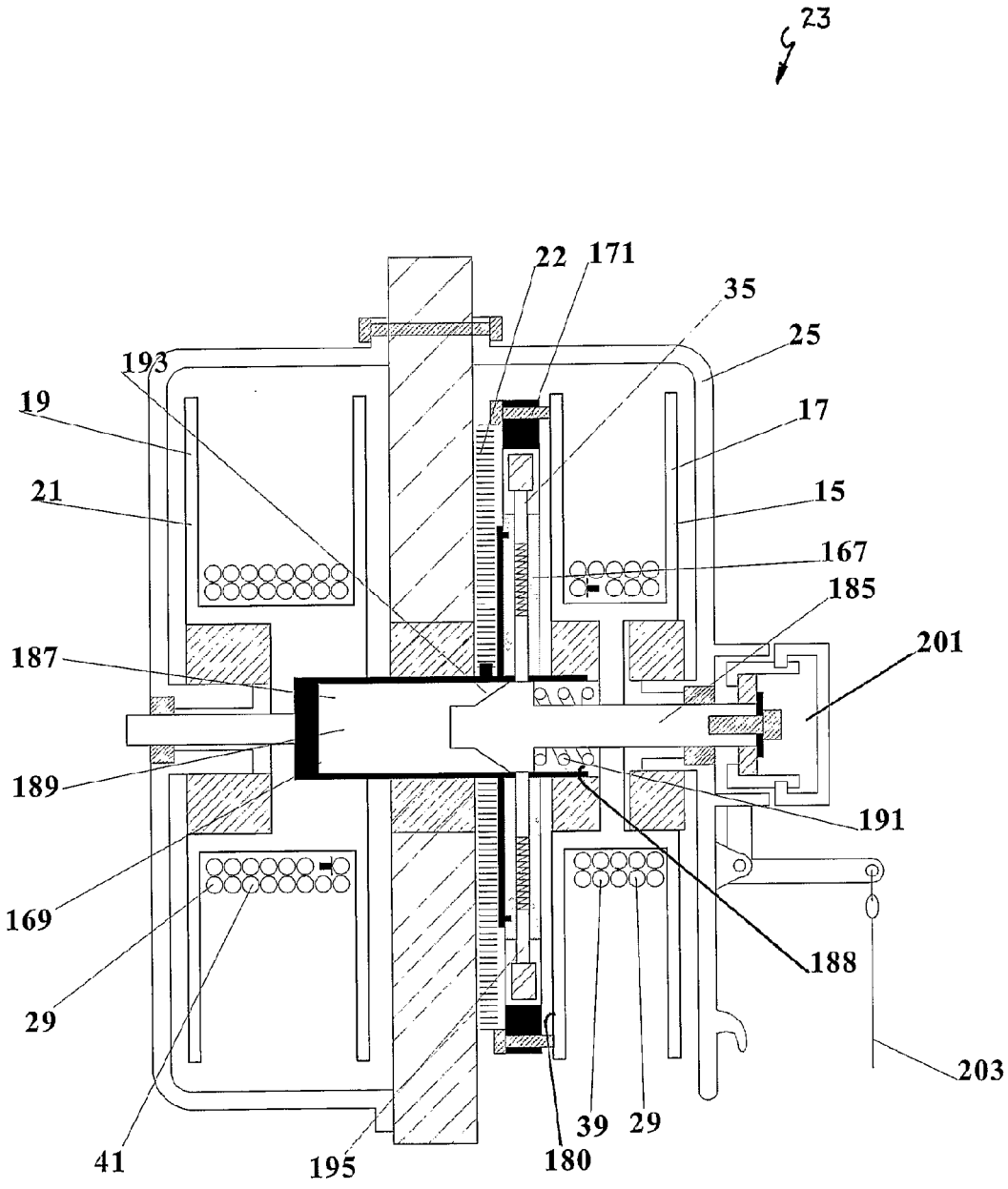
FIG. 6 is a cross sectional view of a first support assembly in a locked condition of the safety apparatus according to a second embodiment.
Figure 7:
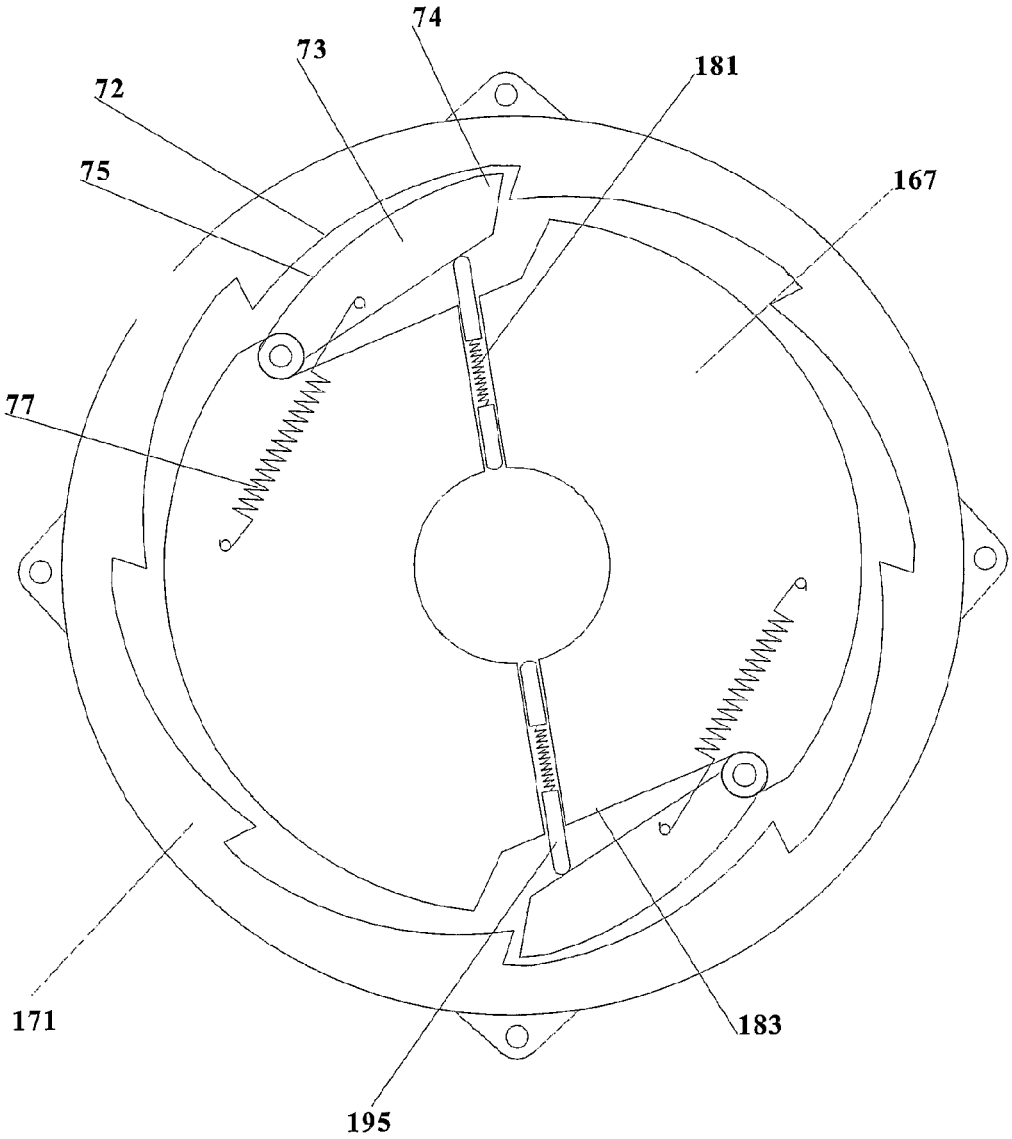
FIG. 7 is a side view of the locking device according to the second embodiment.

In a second embodiment, the locking devices 35 normal state is the locked condition. As shown in FIGS. 6 and 7 the locking device 35 according to the second embodiment is in the form of a plate 167 coaxially mounted with the first spool 17 and second spool 21 on a shaft assembly 169.

The shaft assembly 169 comprises a first shaft 185 partially received in a hollow portion 189 of a second shaft 187 through opening 188. When assembled the first shaft 185 is biased inwardly, away from the opening 188 by spring 191. The end of the first shaft 189 has a tapered profile 193.

The plate 167 has two bores 181 extending from the outer face 183 of the plate 167 to the second shaft 187. When the locking device 35 is in the locked condition the first shaft 185 blocks the end of each bore exposed to the hollow portion 189. Each bore 181 houses a pushrod 195 which is biased inwardly.

Secured to an outer portion 180 of the first spool 17 is a ring 171. As best shown in FIG. 7, the ring 171 incorporates a plurality of indents 72 spaced at regular intervals around the inner face of the ring 171.

The locking device 35 also comprises two teeth 173 rotatably mounted on the plate 167 such that each tooth is capable of blocking the end of each bore 181 at the outer periphery of the plate 169. Each tooth 173 has an outer surface 75 complimentary to each indent 72. Each tooth 173 has a spring 177 extending from the tooth 173 to the plate 167, biasing the end 174 of each tooth 171 towards the centre of the plate 167.

When assembled the teeth 173 are in the same plane as the ring 171.

In the locked condition, each pushrod 195 protrudes from its bore 181 engaging the tooth 73 such that the end 174 of the tooth 73 is in engagement with an indent 72, partially locking the first spool 17 and second spool 21 relative to each other, allowing rotational movement in one direction only. In this direction the support line will retract in to the first housing.

The locking device 35 also incorporates a release mechanism 201 allowing the operator 13 to move the locking device 35 into the released condition. The release mechanism 35 incorporates a flexible connection in the form of a rope 203, allowing the operator 13 to move the locking device 35 in to the released condition when at a distance from the first housing 25.

When operated, the release mechanism 201, forces the tapered profile of the first shaft 185 to move outwardly towards the opening 188 of the second shaft 187. This results in the tapered profile 193 passing by the opening of the bores 181. As this occurs the pushrods 195 retract inwardly, allowing the teeth 73 to disengage the indents 72 to allow the first spool 17 and second spool 21 to rotate independently.

Even with the locking device 35 in its released condition, the locking device 35 will move to the locked condition when the rotational velocity of the first spool 17 is sufficient such that the centrifugal force exerted upon each tooth 73 overcomes the biasing means of the springs 177 and the teeth 73 each engage an indent 72, locking the first spool 17 to the second spool 21. In this condition the length of the support line 29 extending between the first spool 17 and second spool 21 will not increase.

Figure 8:
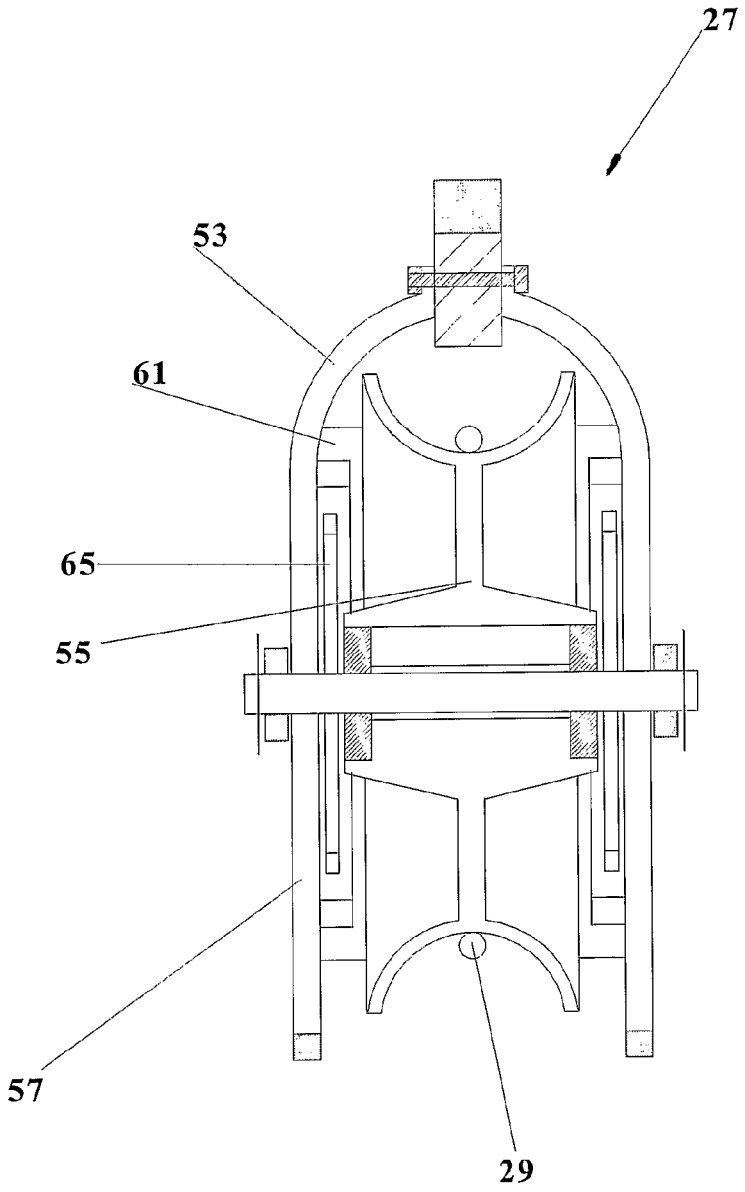
FIG. 8 is a cross sectional view of a second support assembly according to the second embodiment.
Figure 9:
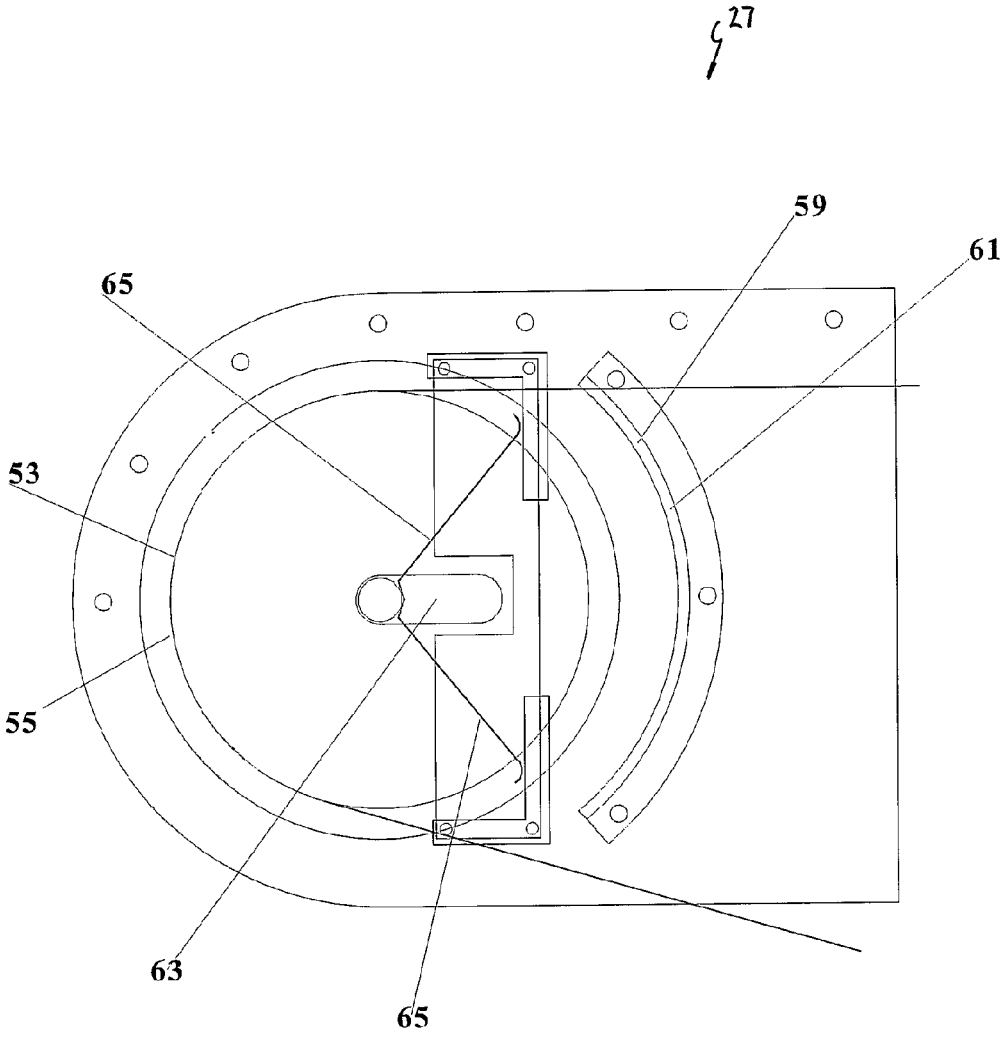
FIG. 9 is a cross sectional side view of the second support assembly according to the second embodiment.

Referring to FIGS. 8 and 9, the second support assembly 27 according to a second embodiment is in the form of a pulley 53 comprising a wheel 55 rotatably retained in a bracket 57. The pulley 53 also incorporates a braking means 59 in the form of a brake lining 61 and a spring 65. As can be seen in FIG. 9, the wheel 55 is mounted in slotted apertures 63 and is biased towards the rear of the slotted apertures 63 by the spring 65. Should the operator 13 fall, the load placed upon the wheel 55 will overcome the biasing force and force the wheel 55 to move towards and engage the brake lining 61, braking the rotation of the wheel 55. This will assist in absorbing some of the impact the operator 13 will experience when the safety apparatus stops the operators 13 descent. The braking means 59 will also assist in preventing lateral movement of the fallen operator 13 towards a central point between the first housing 25 and second support assembly 27.

In a further embodiment the safety apparatus 11 comprises a combination of the previous two embodiment. Obviously further embodiments are also covered in the spirit of this specification and is not limited to those embodiments described herein.

Modifications and variations such as would be apparent to the skilled addressee are considered to fall within the scope of the present invention.

Throughout the specification, unless the context requires otherwise, the word "comprise" or variations such as "comprises" or "comprising", will be understood to imply the inclusion of a conditioned integer or group of integers but not the exclusion of any other integer or group of integers.

The invention claimed is:

1. A safety apparatus comprising:

a first spool and a second spool each adapted to be releasably secured to a structure, a locking device operably movable between a released condition whereby the first spool and the second spool can rotate independently of each other, and a locked condition whereby each of the first spool and the second spool is partially locked relative to each other in a manner which prevents a length of a support line between the first spool and second spool from increasing, and the support line having a portion adapted to receive and support a securing device attached to an operator, the support line extending from the first spool to the second spool, via a second support assembly, wherein the locking device, when in the locked condition, partially locks the first and second spools relative to each other such that the first and second spools are incapacitated to feed the support line out simultaneously whilst still being capable of rotating independently from each in a manner which will retract the support line simultaneously; and wherein, when the apparatus supports a fallen operator, the locking device is maintained in the locked condition, partially locking the first spool relative to the second spool, preventing the length of the support line between the first spool and second spool from increasing, therefore preventing the operator from falling any further.

2. The apparatus according to claim 1 wherein the support line has a first end secured to the first spool and a first portion adjacent the first end retractably received by the first spool.

3. The apparatus according to claim 1 wherein the support line has a second end secured to the second spool and a second portion adjacent the second end retractably received by the second spool.

4. The apparatus according to claim 1 wherein, when the locking device is in the locked condition, the first spool and second spool are capable of rotating in a manner whereby the length of the support line fed from one of the first spool and the second spool is retracted by the other of the first spool and the second spool.

5. The apparatus according to claim 1 wherein the first spool is rotatably mounted to a first support assembly.

6. The apparatus according to claim 5 wherein the first support assembly is releasably secured to the second support assembly for easy handling and transportation of the apparatus when not in use.

7. The apparatus according to claim 5 wherein the second spool is rotatably mounted to the first support assembly such that the first spool and the second spool may rotate independently of each other when the locking device is in the released condition.

8. The apparatus according to claim 1 wherein the first spool and second spool are mounted coaxially on a shaft.

9. The apparatus according to claim 1 wherein the first spool and the second spool are each biased in a manner which maintains a retractive force upon the support line.

10. The apparatus according to claim 1 wherein the locking device is a clutch type arrangement or a viscous coupling.

11. The apparatus according to claim 1 wherein the support line comprises a first line retractable upon the first spool, and a second line retractable on the second spool, wherein the first line and second line are releasably connected by a shackle.

12. The apparatus according to claim 11 wherein the securing device attached to the operator is releasably attached to the shackle to secure the operator to the apparatus.

13. A safety apparatus comprising:

a first spool and a second spool each adapted to be releasably secured to a structure, a locking device operably movable between a released condition whereby the first spool and the second spool can rotate independently of each other, and a locked condition whereby each of the first spool and the second spool is locked relative to each other, a support line having a portion adapted to receive and support a securing device attached to an operator, the support line extending from the first spool to the second spool, via a second support assembly, wherein when the apparatus supports a fallen operator the locking device is maintained in the locked condition, locking the first spool relative to the second spool, preventing a length of the support line between the first spool and the second spool from increasing, therefore preventing the operator from falling any further;

wherein a normal state of the locking device is in the released condition, allowing each of the first and second spools to rotate independently; and wherein the locking device moves to the locked condition to lock the spools relative to each other when a velocity of feed from one or both of the first and second spools exceeds a predetermined value, preventing the length of the support line between the first spool and second spool from increasing.

14. A safety apparatus comprising:

a first spool and a second spool each adapted to be releasably secured to a structure, a locking device, in a form of an inertia brake, operably movable between a released condition whereby the first spool and the second spool can move independently of each other, and a locked condition whereby each of the first spool and the second spool is locked relative to each other, a support line having a portion adapted to receive and support a securing device attached to an operator, the support line extending from the first spool to the second spool, via a second support assembly, wherein, when the apparatus supports a fallen operator, the locking device is maintained in the locked condition, locking the first spool relative to the second spool, preventing a length of the support line between the first spool and the second spool from increasing, therefore preventing the operator from falling any further; and wherein a normal state of the locking device is in the released condition, allowing each of the first spool and the second spool to rotate independently.

15. A safety apparatus comprising:

a first receiving means and a second receiving means each adapted to be releasably secured to a structure, a locking device, including at least one tooth and a ring, operably movable between a released condition whereby the first receiving means and the second receiving means can move independently of each other, and a locked condition whereby each of the first receiving means and the second receiving means is locked relative to each other, a support line having a portion adapted to receive and support a securing device attached to an operator, the support line extending from the first receiving means to the second receiving means, via a second support assembly, wherein when the apparatus supports a fallen operator the locking device is maintained in the locked condition, locking the first receiving means relative to the second receiving means, preventing a length of the support line between the first receiving means and the second receiving means from increasing, therefore preventing the operator from falling any further.

16. The apparatus according to claim 15 wherein the locking device is in the locked condition when the at least one tooth engages the ring.

17. The apparatus according to claim 15 wherein the first receiving means comprises a first spool and the second receiving means comprises a second spool, and wherein the at least one tooth is rotatably mounted to one of the first spool and the second spool such that the at least one tooth rotates with the one of the first spool and the second spool.

18. The apparatus according to claim 17 wherein the at least one tooth is mounted on a disc.

19. The apparatus according to claim 18 wherein the disc is mounted to the one of the first and the second spool.

20. The apparatus according to claim 18 wherein the first spool, the second spool and the disc are co-axially mounted.

21. The apparatus according to claim 17 wherein the at least one tooth is mounted directly to the one of the first spool and the second spool.

22. The apparatus according to claim 17 wherein the first spool and second spool are mounted coaxially on a common shaft, and wherein the at least one tooth is biased towards an axis of the shaft.

23. The apparatus according to claim 17 wherein the ring of the locking device is mounted directly or indirectly to the other spool than to which the at least one tooth is rotatably mounted such that the ring rotates with the other spool.

24. The apparatus according to claim 23 wherein the ring is mounted on a plate coaxially mounted with the first spool and second spool.

25. The apparatus according to claim 23 wherein the first spool, second spool and ring are co-axially mounted.

26. The apparatus according to claim 15 wherein the ring and the at least one tooth lie in a same plane.

27. The apparatus according to claim 15 wherein the ring has a plurality of indents spaced at regular intervals incorporated within an inner periphery of the ring.

28. The apparatus according to claim 27 wherein the at least one tooth engages at least one of the plurality of indents of the ring when the locking device is in the locked condition.

29. The apparatus according to claim 28 wherein the at least one tooth engages at least one of the plurality of indents upon a velocity of support line fed out reaching a predetermined velocity.

30. A safety apparatus comprising:

a first receiving means and a second receiving means each adapted to be releasably secured to a structure, a locking device operably movable between a released condition whereby the first receiving means and the second receiving means can move independently of each other, and a locked condition whereby each of the first receiving means and the second receiving means is locked relative to each other, a support line having a portion adapted to receive and support a securing device attached to an operator, the support line extending from the first receiving means to the second receiving means, via a second support assembly, wherein, when the apparatus supports a fallen operator, the locking device is maintained in the locked condition, locking the first receiving means relative to the second receiving means, preventing a length of the support line between the first receiving means and the second receiving means from increasing, therefore preventing the operator from falling any further; and wherein the locking device incorporates a visual indicator indicating the condition of the locking device.

31. A safety apparatus comprising: a first spool and a second spool each adapted to be releasably secured to a structure, a locking device, in a form of an inertia brake, operably movable between a released condition whereby the first spool and the second spool can move independently of each other, and a locked condition whereby each of the first spool and the second spool is locked relative to each other, a support line having a portion adapted to receive and support a securing device attached to an operator, the support line extending from the first spool to the second spool, via a second support assembly, wherein, when the apparatus supports a fallen operator, the locking device is maintained in the locked condition, locking the first spool relative to the second spool, preventing a length of the support line between the first spool and the second spool from increasing, therefore preventing the operator from falling any further; and wherein at least one of the first spool and the second spool is rotatably mounted to a first support assembly which includes a handle which may rotate one or both spools.

32. The apparatus according to claim 31 wherein the handle is coaxially mounted with the first spool and second spool.

33. A safety apparatus comprising: a first receiving means and a second receiving means each adapted to be releasably secured to a structure, a locking device operably movable between a released condition whereby the first receiving means and the second receiving means can move independently of each other, and a locked condition whereby each receiving means is locked relative to each other, and a support line having a portion adapted to receive and support a securing device attached to an operator, the support line extending from the first receiving means to the second receiving means, via a second support assembly, wherein, when the apparatus supports a fallen operator, the locking device is maintained in the locked condition, locking the first receiving means relative to the second receiving means, preventing a length of the support line between the first receiving means and the second receiving means from increasing, therefore preventing the operator from falling any further; and wherein the second support assembly is in a form of a pulley comprising a wheel retained in a bracket, and wherein the pulley incorporates a braking means to provide resistance to rotation of the wheel when a predetermined force is exerted thereupon.

34. The apparatus according to claim 33 wherein the braking means comprises a brake lining.

35. The apparatus according to claim 34 wherein the wheel is biased away from the brake lining.

36. The apparatus according to claim 33 wherein the pulley is biased away from the braking means by a biasing means comprising at least one spring.

* * * * *